United States Patent [19]

Simm et al.

[11] Patent Number: 4,609,401

[45] Date of Patent: Sep. 2, 1986

[54] POWDERED MATERIAL FOR THERMAL SPRAYING

[75] Inventors: Wolfgang Simm, Ecublens; Hans-Theo Steine, Chavannes, both of Switzerland

[73] Assignee: Castolin S.A., Saint-Sulpice, Switzerland

[21] Appl. No.: 673,758

[22] PCT Filed: Feb. 20, 1984

[86] PCT No.: PCT/CH84/00028

§ 371 Date: Oct. 18, 1984

§ 102(e) Date: Oct. 18, 1984

[87] PCT Pub. No.: WO84/03306

PCT Pub. Date: Aug. 30, 1984

[30] Foreign Application Priority Data

Feb. 23, 1983 [CH] Switzerland ..... 1015/83

[51] Int. Cl.[4] ..... C22C 29/00; C22C 32/00

[52] U.S. Cl. ..... 75/252

[58] Field of Search ..... 75/252

[56] References Cited

U.S. PATENT DOCUMENTS

| | | | |
|---|---|---|---|
| 3,723,165 | 3/1973 | Longo | 75/252 |
| 4,192,672 | 3/1980 | Moskowitz et al. | 75/252 |
| 4,507,151 | 3/1985 | Simm et al. | 75/252 |

*Primary Examiner*—Wayland Stallard

*Attorney, Agent, or Firm*—Hopgood, Calimafde, Kalil, Blaustein & Judlowe

[57] ABSTRACT

A powdered material is provided for thermal spraying comprising a mixture of self-fluxing matrix allow powder and a powder of at least one metal carbide, the carbide content of the mixture consisting essentially between 20 and 80 percent by thereof and the matrix alloy having the following composition, in percent by weight:

| | |
|---|---|
| Cr | 18.0–35.0% |
| Fe | 0.1–25.0% |
| B | 0.5–4.5% |
| Si | 0.5–5.5% |
| C | 0.01–2.0% |
| Mo | 0–15.0% |
| Nb | 0–2.0% |
| Ni | Remainder. |

4 Claims, No Drawings

POWDERED MATERIAL FOR THERMAL SPRAYING

The invention relates to a powdered material for thermal spraying comprising a mixture of a self fluxing matrix alloy powder and of a powder of at least one metal carbide.

It is already known to use powdered materials of the above kind to produce corrosion resistant and erosion resistant coatings on metallic substrates by thermal spraying such as a flame spraying. Usually the matrix alloy of the Ni—Cr—Fe—B13 Si type and it generally contains substantially less than 17 percent by weight of Cr. Among the carbides used, it is tungsten carbide which is generally preferred.

The wear resistance of coatings produced with said known materials appears to be unsatisfactory in many cases in particular under the combined action of corrosion and erosion. This is the case for example in transport screws or decanter screws rotating with relatively high speed such as they are used in the chemical industry. The usual coatings formed by a matrix alloy and imbedded carbides are particularly subject to erosion under these conditions and their unsatisfactory behaviour is assumed to be due to the formation of $M_6C$-carbides in the transitional zone between the matrix alloy and the carbide particles as well as to the poor elasticity properties of the matrix alloy, ranging about E=190-00-20000 kp/mm$^2$ at a hardness value of about 60 $R_c$.

The present invention aims at providing a powdered material of the kind mentioned at the beginning, which allows to obtain a coating having an increased resistance against erosion as well as against corrosion.

It has been found, unexpectedly, that an increase of the Cr-content of the matrix alloy allows to improve the elasticity of the same and to reach values of E=15000−16000 kp/mm$^2$, without a reduction in the hardness of the alloy. Accordingly, the corrosion resistance of a layer formed with such a matrix alloy could be substantially increased. In addition it was found that such a matrix alloy with imbedded carbide particles had a subtantially improved resistance against erosion which effect is apparently due to the reduced tendancy to $M_6C$-formation in the transitional zone between the matrix alloy and the carbide particles and thus to the usual tendancy of the layer to become brittle.

The powdered material for thermal spraying according to the invention comprises a mixture of a self fluxing matrix alloy powder of the following composition, in percent by weight:

| | |
|---|---|
| Cr | 18.0-35.0% |
| Fe | 0.1-25.0% |
| B | 0.5-4.5% |
| Si | 0.5-5.5% |
| C | 0.01-2.0% |
| Mo | 0-15.0% |
| Nb | 0-2.0% |
| Ni | Remainder |

with a powder of at least one metal carbide, the carbide content of the mixture being comprised between 20 and 80 percent by weight of this mixture. According to a first preferred embodiment, the carbide used in tungsten monocarbide to provide further increased erosion resistance. In another embodiment the carbides used are in the form of fused tungsten carbide particles. In a further preferred embodiment the carbide particles are coated with Ni. In this case the protective layer on a metal substrate obtained by thermal spraying of the powder mixture of the invention becomes even more resistant against shocks since the carbide particles are more elastically imbedded in the layer. This also allows the use of carbide particles of greater size.

EXAMPLE

A transport screw of 300 millimeters diameter and 1500 millimeters length is coated on the wear exposed surface by flame spraying with simultaneous fusing to obtain a protective coating of one millimeter thickness. The flame spray material used is a mixture of a matrix alloy powder of a grain size corresponding to −125 μm and of a powder of fused tungsten carbide having a grain size corresponding to −105 μm. The weight ratio of the mixture is 50:50 in percent by weight and the composition of the matrix alloy, in percent by weight, was as follows:

| | |
|---|---|
| Cr | 22% |
| Fe | 4% |
| B | 3.5% |
| Si | 4.1% |
| C | 0.6% |
| Mo | 2.5% |
| Nb | 0.1% |
| Ni | Remainder |

It appeared that the duration of life of the transport screw was increased from three months to about one year as compared with a usually coated screw under the same working conditions.

We claim:

1. A powdered material for thermal spraying comprising a mixture of a self-fluxing matrix alloy powder and of a powder of at least one metal carbide, the carbide content of the mixture consisting essentially between 20 and 80 percent by weight thereof and the matrix alloy having the following composition, in percent by weight:

| | |
|---|---|
| Cr | 18.0-35.0% |
| Fe | 0.1-25.0% |
| B | 0.5-4.5% |
| Si | 0.5-5.5% |
| C | 0.01-2.0% |
| Mo | 0-15.0% |
| Nb | 0-2.0% |
| Ni | Remainder |

said powdered material characterized, when thermally sprayed onto a metal substrate to form a bonded coating thereon comprising particles of said carbide dispersed through a zone of said matrix metal, by a decreased presence of $M_6C$-carbide between said matrix zone and the carbide particles and by a marked improvement in elasticity and in resistance to corrosion and erosion.

2. A material in accordance with claim 1, characterized in that said carbide is tungsten monocarbide.

3. A material in accordance with claim 1 or 2, characterized in that the carbide particles are coated with Ni.

4. The powdered material in accordance with claim 1, characterized in that the composition is made up of about 50% by weight of fused tungsten monocarbide and about 50% by weight of the matrix alloy, the composition of said matrix alloy being approximately 22% Cr, 4% Fe, 3.5% B, 4.1% Si, 0.6% C, 2.5% Mo, 0.1% Nb and Ni the remainder.

* * * * *